United States Patent [19]

Howe et al.

[11] 4,261,619

[45] Apr. 14, 1981

[54] CUTTER PICKS

[75] Inventors: Sydney Howe, Dodworth near Barnsley; William S. Clapham, Hoyland, both of England

[73] Assignee: Hall & Pickles Limited, England

[21] Appl. No.: 109,331

[22] Filed: Jan. 3, 1980

[30] Foreign Application Priority Data

Feb. 3, 1979 [GB] United Kingdom ..... 03869/79

[51] Int. Cl.[3] ..... E21C 25/46

[52] U.S. Cl. ..... 299/92; 37/142 A

[58] Field of Search ..... 299/92; 37/142 A; 279/96

[56] References Cited

U.S. PATENT DOCUMENTS 4,154,483 5/1979 Hollingworth ..... 299/92

FOREIGN PATENT DOCUMENTS 2835410 12/1979 Fed. Rep. of Germany ..... 299/92

*Primary Examiner*—Ernest R. Purser

*Attorney, Agent, or Firm*—Lowe, King, Price & Becker

[57] ABSTRACT

A mineral cutting tool comprises a head and a shank extending therefrom for fitting into a socket of a box, the shank having a laterally extending, two-part aperture, the parts thereof communicating with one another, with the first aperture part housing a first portion of a resiient retaining member whereby the latter is secured to the shank, the second aperture part housing, with clearance, a second portion of the resilient retaining member, which second portion is flexibly connected to the first portion, the second portion projecting at least from one end of the second aperture part for abutting engagement, in use, with the socket of the box.

16 Claims, 6 Drawing Figures

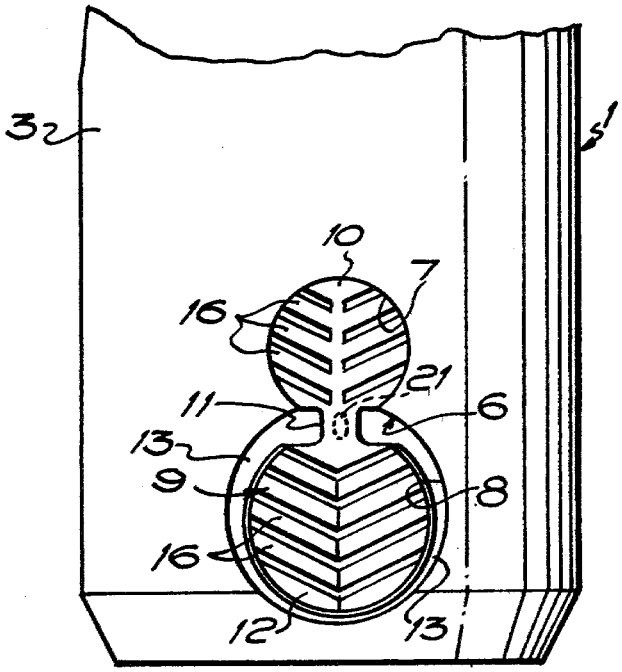
FIG. 5
FIG. 6
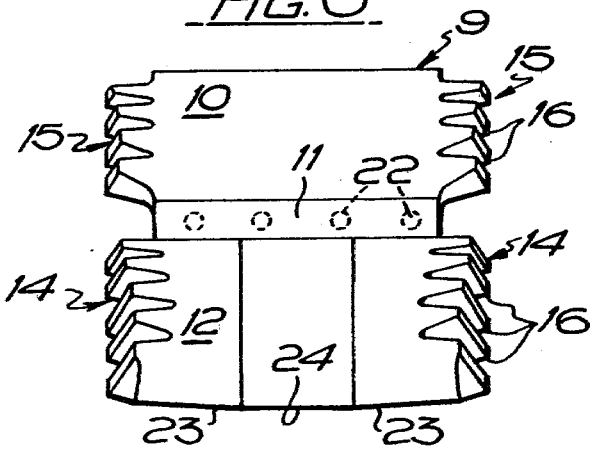

CUTTER PICKS

This invention relates to a replaceable, mineral cutting tool e.g. a cutter pick incorporating a carbide tip or a tool incorporating a rotary cutting element and a means for replaceably retaining a tool in a socket of a tool box, a plurality of the latter being mounted, usually by welding, on cutting heads, discs or drums, e.g. of mineral winning machines, underground roadway driving machines, or planing machines for removing road surfaces.

The object of the present invention is to provide a simple cutting tool retaining arrangement which remains secure even when the tool is located in a tool box having a badly worn socket.

According to the present invention, a mineral cutting tool comprises a head and a shank extending therefrom for fitting into a socket of a tool box, the shank having a laterally extending, two-part aperture, which parts communicate with one another, with a first aperture part housing a first portion of a resilient retaining member whereby the retaining member is secured to the shank, and with a second aperture part housing, with clearance, a second portion of the resilient retaining member, which second portion is flexibly connected to the first portion, the second portion projecting at least from one end of the second aperture part for abutting engagement, in use, with a socket of a tool box.

Thus with a worn socket, where rocking of the shank in the socket will occur during use of the cutting tool, the projecting end (s) of the second portion engages one side or alternatively two opposite sides, of the socket and transmits retaining forces to the shank through the first portion, while the freedom of movement of the second portion resulting from its clearance in the second aperture part allows the shank and hence the first portion to rock without disturbing the second portion, the latter remaining stationary and thereby avoiding wear on the projecting end(s) of the second portion by abrasion against the socket. It follows of course that the amount of clearance afforded the second portion is determined in accordance with the maximum amount of socket wear likely to be encountered in service.

The first and second portions of the retaining member are preferably made of one material, e.g. polyurethane, as a one-piece moulding, but they could also be made of different materials (or different qualities of one material) joined or co-moulded together.

Conveniently, the first and second portions of the resilient retaining member are flexibly connected together by a web. It follows that the cross-sectional area of the web, and/or its length, may be varied to provide optimum flexibility for particular service conditions. The web may additionally be pierced or apertured in lateral and/or longitudinal directions to provide multiple connecting webs, this technique improving the flexibility of the web whilst reducing the amount of material of the retaining member.

The shank may be circular or non-circular. If the second portion of the retaining member has only one projecting end, the second aperture part may be a blind hole. Alternatively the latter may be a through hole if the second portion of the retaining member has two opposed projecting ends. Furthermore, one or both ends of the first portion (and possibly also the web) may extend beyond one or both ends of the first aperture part for abutting engagement with the socket, so as to enhance the hold of the projecting end(s) of the second portion in the socket.

However, the or each projecting end is preferably provided with toothed, stepped, or otherwise interrupted surfaces to provide a plurality of resiliently deformable fins and/or fingers for engagement with a portion(s) of a socket e.g. a side of a socket, an edge(s) of a hole(s), or cutaway(s) in a socket. These interrupted surfaces may be planar or may be convex for engagement with a portion of the socket having complementary curvature.

The aperture may have a cross-section shaped generally as a figure eight with the retaining member having a similar cross-section. In detail, the first aperture part may be a smaller diameter lobe of the aperture and the second aperture part a larger diameter lobe. Alternatively, the two lobes of the aperture may be of the same diameter. The intersections of the lobes of the aperture may be sharp, rounded, or flattened, so as to afford freedom of movement of the connecting web. The second portion may be generally barrel-shaped so as to develop a self-cleaning action in the larger lobe, which is preferably located further from the head of the cutting tool than the smaller lobe.

The invention will now be described in greater detail, by way of example, with reference to the accompanying drawings, in which:

FIG. 5 is an enlarged view of the shank of a third embodiment of pick in accordance with the present invention; and FIG. 6 is a side elevation of the resilient retaining member of FIGS. 3 to 5.

In all Figures, like reference numerals are used for like elements.

Figure 1:
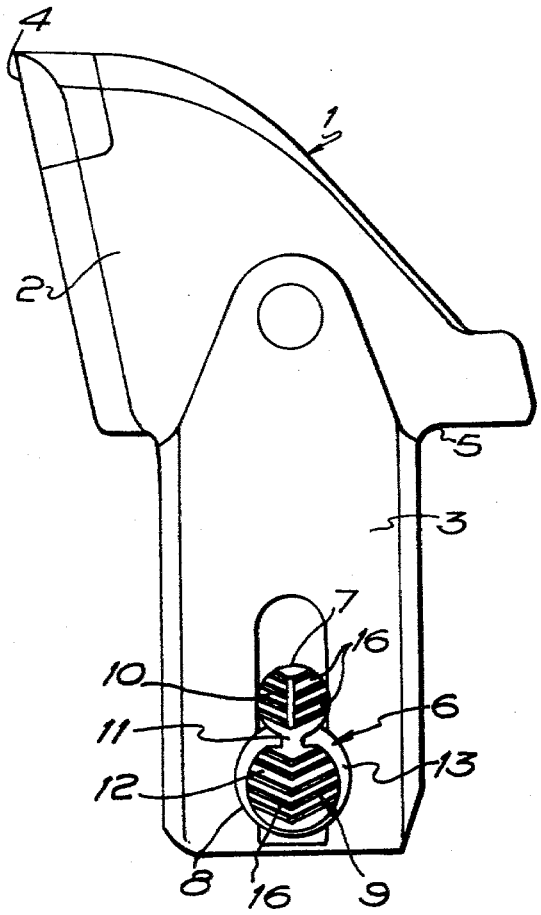
FIG. 1 is a side elevation of a first embodiment of cutter pick in accordance with the present invention.
Figure 2:
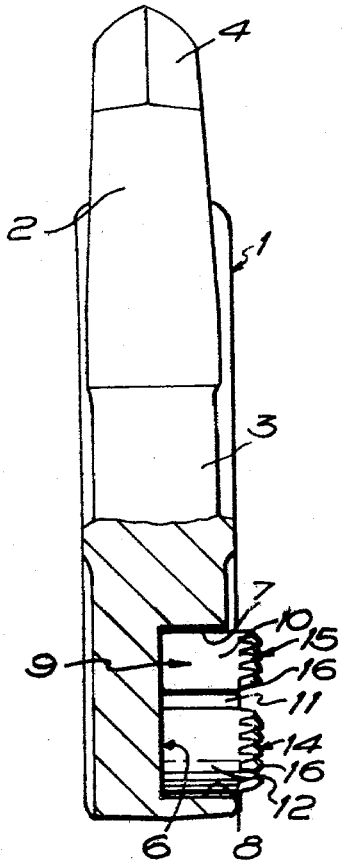
FIG. 2 is a side elevation of FIG. 1.

In the drawings, a cutter pick 1 comprises a head 2 and a shank 3. The head 2 has a carbide cutting tip 4 and seating shoulders 5, while the shank 3 has a laterally extending aperture 6. In the embodiment of FIGS. 1 and 2, the aperture 6 is a blind hole, while in the embodiment of FIGS. 3 and 4 the aperture 6 is a through hole. In all embodiments however, the aperture 6 has a cross-section shaped generally as a figure eight, comprising a smaller lobe, first aperture part 7 and a larger lobe, second aperture part 8, the two parts communicating with one another.

A resilient, polyurethane retaining member 9 has a cross-section corresponding generally to the aperture 6. Thus the retaining member 9 comprises a first portion 10 which is a tight fit in the first aperture part 7 and is connected by a flexible web 11 to a second portion 12 which is of smaller cross-section than the second aperture part 8 so that clearances 13 are defined between the second portion 12 and the second aperture part 8.

In the embodiment of FIGS. 1 and 2, one end 14 of the second portion 12, and one end 15 of the first portion 10 of the retaining member 9, project beyond the end of their respective aperture parts 8 and 7. Each end 14 is interrupted to provide a plurality of resiliently deformable fins 16 disposed in chevron configuration as shown in FIG. 1.

Figure 3:
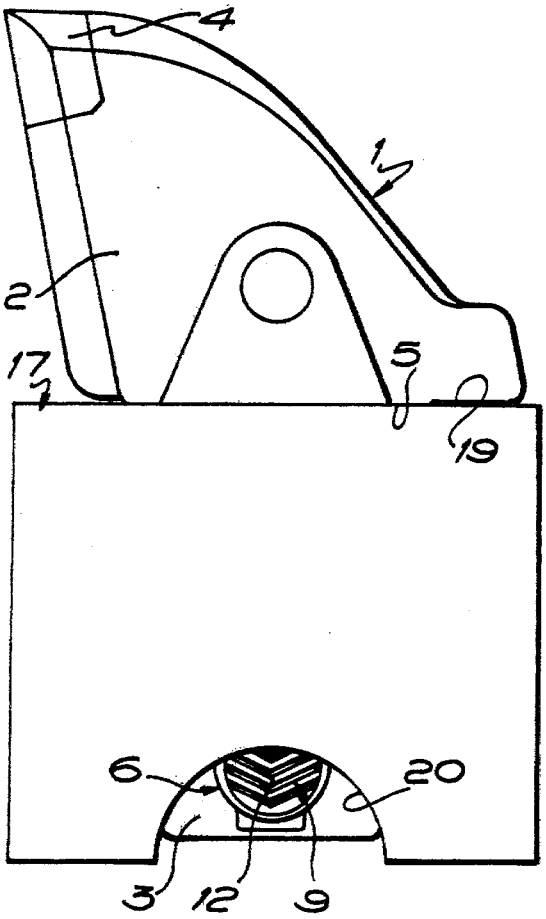
FIG. 3 is a side elevation of a second embodiment of cutter pick in accordance with the present invention, shown located in a pick box.
Figure 4:
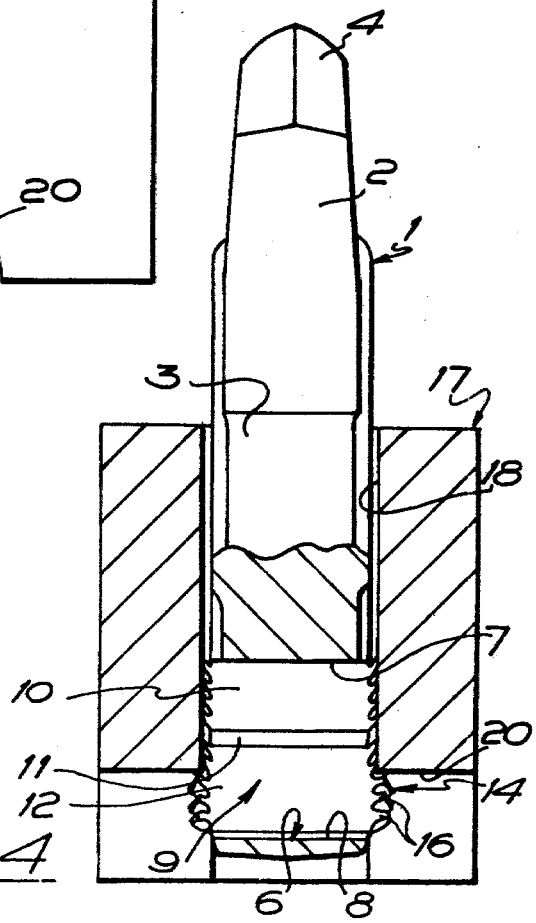
FIG. 4 is a part sectional view through FIG. 3.

In the cutter pick 1 shown in the embodiment of FIGS. 3 and 4, and the resilient retaining member 9 shown in FIG. 6, opposite ends 14 of the second and first portions 12 and 10 project in this manner.

As shown in FIGS. 3 and 4, the cutter pick 1 is retained by its shank 3 in a pick box 17. For this purpose the pick box 17 is provided with a socket 18 of cross-section corresponding to that of the shank 3 so that when the shank 3 is fully inserted into the socket 18, the seating shoulders 5 abut upper surface 19 of the pick box. The pick box 17 is also provided with a transverse groove 20 and as shown in FIG. 4, some fins 16 remain deformed and frictionally engage the socket 18, while other fins 16 that have passed out of the lower end of the socket 18 engage the groove 20.

In the embodiment of FIG. 5 the shank 3 is of circular section. Furthermore, the web 11 may have one or more longitudinal apertures 21 and/or one or more lateral apertures 22 as indicated in FIG. 6. FIG. 6 also indicates a one piece polyurethane moulding of the retaining member 9, with a barrel-shaped second portion 12, the surfaces 23 tapering inwardly from opposite sides of a central surface 24.

In use, the shank 3 is retained within the socket 18 primarily by the fins 16 of the second portion 12 and to a smaller extent by the fins 16 of the first portion 10. However, the socket 18 will eventually become worn which will cause the shank 3 to rock in the socket 18. However, although the fins 16 of the first portion 10 will abrade, and eventually become inefficient as regards their shank retention capability, the fins 16 of the second portion 12 remain stationary because the second portion 12 does not rock with the pick shank 3, the differential movement between the first and second portions 10, 12, being accommodated by the flexible web 11.

What we claim is:

1. A mineral cutting tool comprising a head, a shank extending from said head for fitting into a socket of a tool box, a laterally extending, two-part aperture provided in said shank, said parts communicating with one another, a resilient retaining member, a first one of said aperture parts housing a first portion of said resilient retaining member, whereby said retaining member is secured to said shank, and a second one of said aperture parts housing, with clearance, a second portion of said resilient retaining member, which second portion is flexibly connected to said first portion, said second portion projecting at least from one end of said second aperture part for abutting engagement, in use, with a socket of a tool box.

2. A cutting tool as claimed in claim 1, wherein said first and second portions of said retaining member are made of one material.

3. A cutting tool as claimed in claim 1, wherein said material is polyurethane.

4. A cutting tool as claimed in claim 2 or claim 3, wherein said first and second portions of said retaining member are a one-piece moulding.

5. A cutting tool as claimed in claim 1, wherein said first and second portions of said resilient retaining member are flexibly connected together by a web.

6. A cutting tool as claimed in claim 5, wherein said web is apertured in lateral and/or longitudinal directions to provide multiple connecting webs.

7. A cutting tool as claimed in claim 1, wherein said shank is circular.

8. A cutting tool as claimed in claim 1, wherein said shank is non-circular.

9. A cutting tool as claimed in claim 1, wherein said second aperture part is a blind hole.

10. A cutting tool as claimed in claim 1, wherein said second aperture part is a through hole.

11. A cutting tool as claimed in claim 1, wherein one or both ends of said first portion extend beyond one or both ends of said first aperture part for abutting engagement with said socket.

12. A cutting tool as claimed in claim 1, wherein said projecting end(s) is provided with an interrupted surface to provide a plurality of resiliently deformable projections for engagement with said socket.

13. A cutting tool as claimed in claim 12, wherein said interrupted surface is planar.

14. A cutting tool as claimed in claim 1, wherein said aperture has a cross-section shaped generally as a figure eight with said retaining member having a similar cross-section.

15. A cutting tool as claimed in claim 14, wherein said first aperture part is a smaller diameter lobe of said aperture and said second aperture part a larger diameter lobe.

16. A cutting tool as claimed in claim 14, wherein said second portion is generally barrel-shaped.

* * * * *